US008366909B2

(12) United States Patent
Miller

(10) Patent No.: US 8,366,909 B2
(45) Date of Patent: Feb. 5, 2013

(54) REFORMING PROCESS AT LOW PRESSURE

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 481 days.

(21) Appl. No.: 12/393,912

(22) Filed: Feb. 26, 2009

(65) Prior Publication Data

US 2010/0213101 A1 Aug. 26, 2010

(51) Int. Cl.
*C10G 35/06* (2006.01)

(52) U.S. Cl. ..... 208/65; 208/63; 208/133; 208/134; 208/138

(58) Field of Classification Search ..... 208/63, 208/65, 133–134, 138
See application file for complete search history.

(56) References Cited

U.S. PATENT DOCUMENTS

| | | | | |
|---|---|---|---|---|
| 3,308,069 | A * | 3/1967 | Rosinski et al. | 502/62 |
| 3,923,641 | A | 12/1975 | Morrison | |
| 4,181,599 | A | 1/1980 | Miller et al. | |
| 4,190,519 | A | 2/1980 | Miller et al. | |
| 4,284,529 | A * | 8/1981 | Shihabi | 502/71 |
| 4,370,219 | A | 1/1983 | Miller | |
| 4,569,827 | A * | 2/1986 | Wright et al. | 422/610 |
| 4,647,368 | A | 3/1987 | McGuiness et al. | |
| 4,764,266 | A | 8/1988 | Chen et al. | |
| 4,812,223 | A | 3/1989 | Hickey, Jr. et al. | |
| 4,851,109 | A | 7/1989 | Chen et al. | |
| 5,052,561 | A | 10/1991 | Miller et al. | |
| 5,169,813 | A | 12/1992 | Miller et al. | |
| 5,182,012 | A | 1/1993 | Miller et al. | |
| 5,233,121 | A | 8/1993 | Modica | |
| 5,302,769 | A | 4/1994 | Marler et al. | |
| 5,358,631 | A | 10/1994 | Miller et al. | |
| 5,401,389 | A | 3/1995 | Mazzone et al. | |
| 5,409,595 | A | 4/1995 | Harandi et al. | |
| 5,411,658 | A | 5/1995 | Chawla et al. | |
| 5,413,696 | A | 5/1995 | Fletcher et al. | |
| 5,413,698 | A | 5/1995 | Fletcher et al. | |
| 5,603,824 | A | 2/1997 | Kyan et al. | |
| 5,643,441 | A | 7/1997 | Timken et al. | |
| 5,685,972 | A | 11/1997 | Timken et al. | |
| 6,709,571 | B1 | 3/2004 | Del Rossi et al. | |
| 7,074,384 | B2 | 7/2006 | Mertens et al. | |
| 2005/0000859 | A1 * | 1/2005 | Hung et al. | 208/133 |
| 2007/0102321 | A1 | 5/2007 | Wang | |
| 2009/0301933 | A1 | 12/2009 | Miller et al. | |
| 2009/0301934 | A1 | 12/2009 | Miller et al. | |

FOREIGN PATENT DOCUMENTS

| | | | |
|---|---|---|---|
| EP | 0280476 | B1 | 3/1993 |
| EP | 0722479 | B1 | 9/1994 |
| EP | 0819157 | B1 | 2/1996 |
| EP | 0893487 | B1 | 7/1997 |
| EP | 0641375 | B1 | 12/1997 |

OTHER PUBLICATIONS

Kulprathipanja, S. (2010). "Aspects of Mechanisms, Processes, and Requirements for Zeolite Separation" in Zeolites in Industrial Separation and Catalysis, edited by S. Kulprathipanja, Wiley, 647 pgs.*
Wallau, M. et al. (1995). J. Braz. Chem. Soc., 6(4), 393-403.*

* cited by examiner

*Primary Examiner* — Brian McCaig
(74) *Attorney, Agent, or Firm* — Chloe Zubieta; E. Joseph Gess

(57) ABSTRACT

Processes for reforming of naphtha feedstocks are described. Briefly, a two stage naphtha reforming process is described. The first stage uses a low acidity beta zeolite catalyst under relatively mild reforming conditions to form an effluent. This effluent is passed to a subsequent stage where further reforming occurs using a catalyst containing ZSM-5 zeolite. The second stage is run under mild reforming conditions. The low pressures employed in the reforming process described maximize liquid product yield by avoiding unwanted cracking reactions and production of light products.

20 Claims, No Drawings

REFORMING PROCESS AT LOW PRESSURE

FIELD OF THE INVENTION

The present invention relates to a multistage reforming process using a beta zeolite catalyst in a penultimate stage and a ZSM-5 catalyst in a final stage at low hydrogen partial pressure to produce a high octane naphtha product at high liquid yield.

BACKGROUND OF THE INVENTION

Catalytic reforming is one of the basic petroleum refining processes for upgrading light hydrocarbon feedstocks, frequently referred to as naphtha feedstocks. Naphtha feedstocks can include paraffins, isoparaffins, olefins, cycloparaffines, aromatics, and naphthenes. Generally, naphtha feedstocks boil up to 450° F. and contain hydrocarbons with molecular weights from 100 to 250 g/mol. Products from catalytic reforming of naphtha feedstocks can include gasoline for use in automobiles, aromatics such as benzene, toluene, xylene and ethylbenzene for use as solvents and chemicals, and hydrogen for use in various refining processes. Reactions typically involved in catalytic reforming include dehydrocylization, isomerization, dehydrogenation, dealkylation, and hydrocracking. Dehydrocyclization and dehydrogenation of linear and slightly branched alkanes and dehydrogenation of cycloalkanes lead to the production of aromatics and are often desired reactions in reforming. Dealkylation and hydrocracking are generally undesirable due to the low value of the resulting light hydrocarbon products.

Catalysts commonly used in commercial reforming reactions often include inorganic oxides and one or more Group VIII metals, such as platinum or palladium, or a Group VIII metal plus a second catalytic metal, which acts as a promoter. The inorganic oxide can act as a support for the Group VIII metal as well as imparting some catalytic activity due to the presence of acid sites in the inorganic oxide. Crystalline inorganic oxides such as zeolites and noncrystalline inorganic oxides such as amorphous silica alumina may be used as supports. Halogens such as chlorine can be incorporated on the support to increase acid functionality. Alkali metals such as sodium, potassium, and cesium can be incorporated on the support to decrease acidity. By controlling the amount of acidity and using different catalytic metal or metals, the activity of the reforming catalyst can be tuned for optimum use of different feedstocks and/or for optimum production of desired products such as high octane gasoline.

In addition to selection of catalysts for reforming, various processes for reforming a naphtha feedstock in one or more process steps to produce higher value reformate products are known in the art. Generally one or more process steps are used to increase the RON (research octane number) and aromatic content of the naphtha feedstock. Process conditions of temperature and pressure can be varied depending on the catalyst or catalysts used, the feedstock, and the desired products. In addition, fractionation steps can be employed between steps to select for certain products and maximize yield.

Even with the advances in naphtha reforming catalysts and processes, a need still exists to develop new and improved reforming methods to provide higher liquid yield, minimize the formation of less valuable low molecule weight ($C_1$-$C_4$) products, and improve the economic viability of costly high pressure multi stage reforming. It has been discovered that the replacement of a conventional reforming catalyst with a beta zeolite catalyst in a penultimate stage and a silicalite catalyst in a final stage of a staged reforming process allows the process of the invention to be run at lower pressure than under conventional process conditions while yielding a product with a comparable RON, aromatics content, C5+ liquid yield, hydrogen production, and catalyst life. A clear economic benefit is realized by running a staged reforming process at lower hydrogen pressure while maintaining high yields of liquid product.

SUMMARY OF THE INVENTION

The invention is directed to a reforming process comprising:

a. contacting a naphtha boiling range feedstock in a penultimate stage of a multi-stage reforming process at a first reforming pressure with a catalyst comprising a low acidity beta zeolite and a Group VIII metal to produce a penultimate effluent; and b. contacting at least a portion of the penultimate effluent in a final stage of the multi-stage reforming process at a second reforming pressure with a catalyst comprising high silica ZSM-5 and a Group VIII metal to produce a final effluent.

In an embodiment the Group VIII metal in the penultimate stage catalyst and in the final stage catalyst comprises platinum. In an embodiment the pressure in the penultimate stage and in the final stage is the same. In a further embodiment, the pressure of the penultimate stage is between 40 psig-200 psig and the pressure in the final stage is between 40 psig-200 psig.

DETAILED DESCRIPTION

In the process of the invention, a naphtha boiling range feedstock is processed in a multi-stage reforming process, which process involves at least a penultimate stage for partially reforming the naphtha feedstock to form a penultimate effluent and a final stage for further reforming at least a portion of the penultimate effluent. While the discussion which follows relates at times, for convenience, to operation of "penultimate" and "final" reforming stages, the principles of the invention are applicable as between any two successive stages and can be applied to several sequentially connected stages. In an embodiment, the penultimate stage and final stage can have an intervening separation stage. In a further embodiment the penultimate stage directly precedes the final stage with no intervening separation stage. In another embodiment one or more stages can occur after the final stage. For example, after the final stage a separation stage can occur. Thus, as used herein, the term "final stage" does not necessarily indicate the last stage in the reforming process, but rather indicates a subsequent stage which follows a preceding (referred to herein as "penultimate") stage.

The reforming process is operated at conditions selected for conducting dehydrocyclization, isomerization and dehydrogenation/aromatization reactions for converting low octane normal paraffins and cycloparaffins into high octane materials. Desired reactions include isomerization of normal paraffins to isoparaffins, dehydrocyclization of normal paraffins to aromatics, and aromatization of cycloparaffins to aromatic compounds. In this way, a product having increased octane and/or containing an increased amount of aromatics is produced. In some embodiments, the multi-stage reforming process is operated at conditions for producing a net positive quantity of hydrogen.

Generally, the reforming process of the invention may be carried out in a multi-stage process by passing a naphtha feedstock through a plurality of reaction stages, provided that the penultimate stage catalyst comprises a low acidity beta zeolite and the final stage catalyst comprises high silica ZSM-5. By "low acidity" it is meant that the beta zeolite exhibits little cracking under reaction conditions. In order to have a low acidity beta zeolite, either the number of acid sites needs to be low, the acid sites present need to be neutralized, or both.

A method of measuring the acidity of a catalyst or catalyst support is ammonia adsorption/desorption. For example, ammonia, or another nitrogen base, is adsorbed onto the catalyst. Total ammonia adsorbed can be determined by, for example, weighing the catalyst before and after ammonia adsorption. The adsorbed ammonia can then be desorbed by heating the sample stepwise and monitoring desorption by mass changes. This method can give an estimate of acid sites as well as the strength of acid sites (due to ease or difficulty in desorbing ammonia) present in the catalyst.

The techniques for determining catalyst acidity measure the number of acid sites in units of milliequivalents (meq) per gram of catalyst. As used here, "milliequivalents" refers to 1 millimole of Lewis or Brønsted acid sites. The amount of adsorbed base is related to the acid site density, and the number of acid sites on which each adsorbent molecule will adsorb. An acid site density of 1 meq/gm catalyst is equivalent to having 1 millimole of base adsorb on a gram of catalyst, when each molecule of base adsorbs on a single acid site. In an embodiment the beta zeolite catalyst used in the process of the invention contains less than 0.25 meq/g. In another embodiment the beta zeolite contains less than 0.15 meq/g.

Acidity in the zeolite is due in part to the +3 oxidation state of aluminum, boron, and/or gallium present in the zeolite. This gives rise to an anionic framework which is compensated by cations such as protons or alkali cations. By decreasing the amount of aluminum, boron, and/or gallium, the zeolite becomes less anionic and thus has fewer possible sites for charge compensating acidic protons. In an embodiment, the beta zeolite has a mole ratio of silica to alumina of greater than about 100 to 1. This type of beta zeolite has a low number of acid sites due to low aluminum content and thus low acidity. One method of reducing acidity of the beta zeolite is ion exchange. By ion exchanging protons for other charge balancing ions such as alkali ions (Group IA) and/or alkaline earth metal ions (Group IIA), the acidity of the beta zeolite can be decreased. In an embodiment the beta zeolite has a mole ratio of X:M, where X is a Group IA metal ion, Group IIA metal ion, or combination thereof and M is Al, B, Ga, or combinations thereof, of at least about 1:5. In an embodiment, M is Al and the mole ratio of X:M is at least 0.9:1. This type of beta zeolite has most of the acids sites present neutralized by alkali and/or alkaline earth metal ions and thus low acidity. By "high silica" it is meant that the ZSM-5 catalyst has a $SiO_2$:$M_2O_3$ ratio of at least 100:1, preferably at least 500:1, and most preferably at least 1000:1. In the process of the invention, the octane of the product from each stage is higher than the octane of the product from a succeeding stage. Successive stages before the final stage can have both the same operating conditions and the same catalyst. To maintain the same temperature in successive stages, interstage heating may be employed to return the feed to the desired temperature after it has been cooled due to the endothermic nature of dehydrogenation and dehydrocyclization reactions. Such interstage heating is commonly used when the temperature drops 35° F. or more, e.g., about 35° F. to about 100° F., in any one stage. Similarly, if two successive stages are referred to as being run at the same pressure it should be realized that the pressures in successive stages may not be identical due to pressure drops across the bed or beds constituting the upstream stage and to pressure drops in any interstage heaters. Thus, when describing a penultimate stage and a final stage as being run at the same pressure, this refers to a pressure within about ±5%.

In general, each reforming stage is characterized by one or more reforming reactor vessels, each containing a catalyst and maintained at reforming reaction conditions. The product from each stage before the final stage is passed, in whole or in part, to the succeeding stage in the multi-stage process. The temperature of the product from each stage which is passed to a succeeding stage may be increased or decreased to meet the particular needs of the process. Likewise, the pressure of the product which is passed to a succeeding stage before the final stage may be increased or decreased.

DEFINITIONS

As disclosed herein, boiling point temperatures are based on ASTM D-86-08 standard distillations at atmospheric pressure, unless otherwise indicated. The mid-boiling point is defined as the 50% by volume boiling temperature, based on an ASTM D-86-08 simulated distillation.

As disclosed herein, carbon number values (i.e. $C_5$, $C_6$, $C_8$, $C_9$ and the like) of hydrocarbons may be determined by standard gas chromatography methods.

As disclosed herein, Research Octane Number (RON) is determined using the method described in ASTM D2699-07.

Unless otherwise specified, as used herein, feed rate to a catalytic reaction zone is reported as the volume of feed per volume of catalyst per hour. In effect, the feed rate as disclosed herein is reported in reciprocal hours (i.e. $hr^{-1}$).

The term "silica to alumina ratio" refers to the molar ratio of silicon oxide ($SiO_2$) to aluminum oxide ($Al_2O_3$) and can be written as ($SiO_2$):($Al_2O_3$). The term "silica to alumina+boron oxide ratio" refers to the molar ratio of silicon oxide ($SiO_2$) to aluminum oxide ($Al_2O_3$) plus boron oxide ($B_2O_3$) and can be written as ($SiO_2$):(($Al_2O_3$)+($B_2O_3$)).

As used herein the term "boron zeolite" refers to a zeolite in which at least a portion of the aluminum has been isomorphously replaced with boron.

When used in this disclosure, the Periodic Table of the Elements referred to is the CAS version published by the Chemical Abstract Service in the Handbook of Chemistry and Physics, $72^{nd}$ edition (1991-1992).

As used herein, a $C_4$− stream comprises a high proportion of hydrocarbons with 4 or fewer carbon atoms per molecule. Likewise a $C_5$+ stream comprises a high proportion of hydrocarbons with 5 or more carbon atoms per molecule. It will be recognized by those of skill in the art that hydrocarbon streams in refinery processes are generally separated by boiling range using a distillation process. As such, the $C_4$− stream would be expected to contain a small quantity of $C_5$, $C_6$ and even $C_7$ molecules. However, a typical distillation would be designed and operated such that at least about 75% by volume of a $C_4$− stream would contain molecules having 4 carbon atoms or fewer per molecule. Thus, at least about 75 wt % of a $C_4$− stream boils in the $C_4$− boiling range. As used herein, $C_5$+, $C_6$-$C_8$. $C_9$+ and other hydrocarbon fractions identified by carbon number ranges would be interpreted likewise.

In the following specification, all U.S. Patents referred to are incorporated by reference in their entirety.

Among other factors, the present invention is based on the discovery that selective reforming of paraffins at relatively low hydrogen pressures in a separate reforming stage provides improved performance of the overall reforming process. Conventional methods using only a single reforming stage require running at relatively high severity to achieve high octane products. The high severity run conditions can lead to shorter catalyst life and/or a lower liquid product yield due to cracking reactions. The process of the invention uses a penultimate stage and a final stage. The penultimate reforming stage is run at relatively low severity with a beta zeolite catalyst. These conditions give higher C5+ yield versus a single reforming stage since it is not necessary to reach the high octane levels normally desired for a naphtha fuel or fuel blend stock in the penultimate stage. In addition, the use of a beta zeolite catalyst in the penultimate reforming stage allows the penultimate stage to be run at lower pressures while still maintaining an economically viable run life. Beta zeolite in the penultimate stage is preferred to conventional amorphous catalysts such as amorphous alumina due to the better stability of beta zeolite at lower pressures. The final reforming stage employed in the process of the invention uses a ZSM-5 catalyst such as silicalite to do the more difficult reforming of the remaining paraffins and to achieve the desired RON for the naphtha fuel or fuel blend stock of the final stage product.

In a preferred embodiment the beta zeolite catalyst used in the penultimate stage has low acidity. Low acidity minimizes any undesired cracking of the naphtha feedstock. The beta zeolite catalyst has good activity and selectivity at low hydrogen pressure such as 50 psig to 150 psig. Under these conditions the beta zeolite catalyst catalyzes the more facile reactions, such as cyclohexane and alkycyclohexane dehydrogenation to produce aromatics, while keeping hydrocracking to a minimum. The effluent produced from the penultimate reforming stage is passed, at least in part, to a final reforming stage containing a ZSM-5 catalyst such as silicalite. The performance characteristics of the final stage catalyst permits operating a final stage in the multi-stage reforming process at a reduced pressure, which increases the selectivity of $C_6$-$C_8$ paraffin dehydrocyclization while maintaining low catalyst fouling rates. The $C_9$+ hydrocarbons from the penultimate stage have higher octane than the $C_6$-$C_8$ hydrocarbons, and do not necessitate further reforming in the final stage. Consequently, the process of the invention provides an economic benefit by maintaining a high octane product at an improved liquid yield under lower hydrogen pressures.

Penultimate Zone Feed

The naphtha boiling range feed entering the penultimate stage of the multi-stage process of the invention is a naphtha fraction boiling within the range of 50° to 500° F., preferably from 60° to 400° F., more preferably from 700 to 360° F., and most preferably from 80° F. to 300° F. In an embodiment, the naphtha feedstock can comprise hydrocarbons wherein at least 85% of the hydrocarbons boil in the range from about 100° F. to about 400° F. In another embodiment, at least 85 wt. % of the naphtha boiling range feedstock boils in the range from about 200° F. to about 360° F. In an embodiment, the feed is a $C_5$+ feed. In another embodiment the feed is a $C_6$+ feed. The feed can include, for example, straight run naphthas, paraffinic raffinates from aromatic extraction or adsorption, and $C_6$-$C_{10}$ paraffin-rich feeds, bioderived naphtha, plant, animal, fungal, or algal derived hydrocarbon feedstocks, naphtha from hydrocarbon synthesis processes, including Fischer Tropsch and methanol synthesis processes, as well as paraffin-containing naphtha products from other refinery processes, such as hydrocracking or conventional reforming. In reforming processes involving more than two stages, the reformer feed may comprise at least a portion of the product generated in a preceding stage. Generally, the sulfur content of the feedstock used in the process of the invention is less than about 5 ppm, preferably less than about 2 ppm, and most preferably less than about 1 ppm. The nitrogen content of the feedstock used in the process of the invention can vary. In an embodiment, the nitrogen content of the feedstock is less than about 1 ppm.

Penultimate Catalyst

The catalyst used in the penultimate stage comprises beta zeolite. Beta zeolite is a large pore zeolite with pores delimited by 12-membered rings wherein the pore aperture measures about 7.4 Å. Beta zeolite is described in U.S. Pat. No. 3,308,069 and RE 28,341, to Wadlinger, herein incorporated by reference. Highly silicious beta zeolite having silica-to-alumina ratios within the range of 20-1000 is disclosed in U.S. Pat. No. 4,923,690, herein incorporated by reference. U.S. Pat. No. 4,661,467, U.S. Pat. No. 4,788,169, U.S. Pat. No. 5,116,794, U.S. Pat. No. 5,258,570, and U.S. Pat. No. 5,693,215 further describe methods of making beta zeolite with differing activities, differing silica to alumina ratios, and/or differing silica to alumina/boron oxide ratios, herein incorporated by reference.

In the process of the invention, the beta zeolite catalyst used in the penultimate stage preferably has low acidity. The acidity of the beta zeolite can be lowered by increasing the silica to alumina ratio. In an embodiment the silica to alumina mole ratio is greater than 20:1, preferably greater than 25:1, more preferably greater than 50:1, and most preferably greater than 100:1. In another embodiment, the beta zeolite can be a borosilicate or a gallosilicate wherein at least a portion of the aluminum is replaced with boron or gallium in the zeolite structure. In an embodiment, the $SiO_2$:$M_2O_3$, where M is Al, B, Ga, or combinations thereof, mole ratio can be greater than 20:1, preferably greater than 25:1, more preferably greater than 50:1, and most preferably greater than 100:1. In an embodiment, the weight percent of aluminum in the borosilicate beta zeolite can be less than 0.1 wt. %.

Other methods to reduce acidity include the incorporation of an alkali metal (Group IA) and/or an alkaline earth metal (Group IIA) into the beta zeolite. Examples of alkali metals used to reduce acidity include sodium, potassium, cesium, and combinations thereof. In an embodiment, at least 90% of the acid sites are neutralized by introduction of the alkali and/or alkaline earth metals. In an embodiment, the mole ratio of Group IA/IIA metal to aluminum (X:Al, where X is a Group IA or Group IIA metal) in the beta zeolite used in the process of the invention can range from about 1:10 to 1:1, with a preferred mole ratio of about 1:5. In an embodiment where the beta zeolite is a borosilicate, the mole ratio of (Group IA/IIA metal) to (aluminum plus boron) (X:(Al+B), where X is a Group IA or Group IIA metal) can range from about 1:10 to 1:1, with a preferred mole ratio of about 1:5.

The penultimate catalyst according to the invention contains one or more Group VIII metals, e.g., nickel, ruthenium, rhodium, palladium, iridium or platinum. The preferred Group VIII metal is platinum. The percentage of the Group VIII metals, such as platinum, in the catalyst is between about 0.01 wt. % and about 5 wt. %, preferably from about 0.2 wt. % to about 2 wt. %.

A number of methods are known in the art to deposit Group VIII metals or metal containing compounds onto the beta zeolite, such as, for example, ion exchange, homogeneous deposition precipitation, redox chemistry, chemical vapor deposition, and impregnation. Preferably, impregnation is used to incorporate Group VIII into the catalyst Impregnation involves exposing the catalyst composition to a solution of the metal or metals to be incorporated followed by evaporation of the solvent. For example, the beta zeolite can be slurried with a solution containing one or more Group VIII metal salts and the mixture stirred until sufficient Group VIII metal is incorporated into the beta zeolite for catalytic activity. The mixture can be stirred at ambient temperature, or higher or lower temperatures for periods of time ranging from hours to days. The temperature and length of time is not critical provided that sufficient metal is incorporated so as to be effective as a catalyst.

Optionally, the catalyst can include a promoter metal. The promoter metal can be incorporated into the beta zeolite catalyst using any method known in the art such as ion exchange, homogeneous deposition precipitation, redox chemistry, chemical vapor deposition, and impregnation. Preferably the promoter metal is tin, rhenium, or combinations thereof. In an embodiment, the catalyst includes sufficient promoter metal to provide a promoter to Group VIII ratio between 0.5:1 and 10:1, more preferably between 1:1 and 6:1, most preferably between 2:1 and 5:1.

Following catalytic metal incorporation, the catalyst can be dried and/or calcined and/or sulfided. In an embodiment, the catalyst is sulfided prior to use. This involves converting the metal components in the catalyst to their sulfided form. The sulfiding can be done by conventional processes, for example, by contacting the catalyst with a sulfur source such as elemental sulfur, sulfur containing compounds, or with a mixture of hydrogen and hydrogen sulfide. In one embodiment, the beta zeolite catalyst comprises platinum and is sulfided with DMDS (dimethyldisulfide) prior to use.

While the penultimate catalyst comprises beta zeolite and at least one Group VIII metal, the penultimate catalyst can further comprise one or more inorganic oxide matrix components such as amorphous alumina. While beta zeolite can be employed with a wide variety of inorganic oxide matrix components, it is important that the pore structure of beta zeolite remain open and readily accessible to the feedstock in order to provide effective catalytic activity. Illustrative inorganic oxide matrix components which may be employed in formulating the penultimate catalyst, include, but are not limited to, amorphous silicas, aluminas, silica-aluminas, silica-zirconias, silica-magnesias, silica-thorias, silica-berylias, silica-alumina-thorias, silica-alumina-zirconias, alumina-borias, alumina-titanias and mixtures thereof. The matrix may be in the form of a sol, hydrogel or gel and is typically an alumina, silica, or silica-alumina component. The matrix may itself provide a catalytic effect, such as that observed for catalytically active silica/aluminas, or it may be essentially inert. The matrix may act as a "binder" in some instances although in some instances the final catalyst may be spray dried or formed without the need of a binder. Generally, the inorganic oxide matrix component can make up from about 5 wt % to about 95 wt % of the penultimate catalyst. In one embodiment, the penultimate catalyst comprises a beta zeolite/alumina support on which is impregnated platinum. Preferably, the penultimate catalyst is ion exchanged with alkali and/or alkali earth metal ions to reduce acidity. In a more specific embodiment, the penultimate catalyst is 65/35 beta zeolite/alumina (wt. %/wt. %) impregnated with about 0.5% platinum and ion exchanged with cesium chloride for a final cesium ion content of about 15 wt. %.

The catalysts in both the penultimate stage and the final stage may be employed in the form of pills, pellets, granules, broken fragments, or various special shapes, disposed as a fixed bed within a reaction zone. The charging feedstock may be passed through the catalyst bed in the liquid, vapor, or mixed phase, and in either upward, downward or radial flow. Alternatively, the catalysts can be used in moving beds or in fluidized-solid processes, in which the charging feedstock is passed upward through a turbulent bed of finely divided catalyst. However, a fixed bed system or a dense-phase moving bed system are preferred due to catalyst attrition losses and other operational advantages. In a fixed bed system, the feed is preheated (by any suitable heating means) to the desired reaction temperature and then passed into a reaction zone containing a fixed bed of the catalyst. This reaction zone may be one or more separate reactors with suitable means to maintain the desired temperature at the reactor entrance. The temperature must be maintained because reforming reactions are typically endothermic in nature.

The actual reforming conditions in both the penultimate and the final reforming stages will depend, at least in part, on the feed used, whether highly aromatic, paraffinic or naphthenic and upon the desired octane rating of the product.

Penultimate Stage Conditions

The penultimate stage is maintained at relatively mild reaction conditions, so as to inhibit the cracking of the stream being upgraded, and to increase the useful lifetime of the catalyst. The naphtha boiling range feedstock to be upgraded in the penultimate stage contacts the penultimate stage catalyst at reaction conditions, which conditions include a temperature in the range from about 800° F. to about 1100° F., a pressure in the range from about 50 psig to about 200 psig, and a feed rate in the range of from about 0.5 $hr^{-1}$ to about 5 $hr^{-1}$. In some embodiments, the pressure in the penultimate stage is in the range from about 75 psig to about 150 psig. The hydrogen to hydrocarbon ($H_2$/hydrocarbon) feed in terms of mole ratio is 1 to 8 and preferably 1 to 5.

Penultimate Stage Product

The effluent from the penultimate stage is an upgraded product, in that the RON has been increased during reaction. The penultimate stage effluent comprises hydrocarbons and hydrogen generated during reaction and at least some of the hydrogen, if any, which is added to the feed upstream of the penultimate stage. The effluent hydrocarbons may be characterized as a mixture of $C_4$− hydrocarbons and $C_5$+ hydrocarbons, the distinction relating to the molecular weight of the hydrocarbons in each group. In embodiments, the $C_5$+ hydrocarbons in the effluent have a combined RON of about 85. In an embodiment, the penultimate stage and the final stage are run in a staged catalyst mode wherein the penultimate stage and the final stage are run with the same hydrogen pressure loop and at the same pressure. In another embodiment, the penultimate stage and the final stage are run with separate hydrogen pressure loops and at different pressures.

Separation Step

The penultimate effluent can undergo an optional separation step prior to contact with the final stage catalyst. The effluent from the penultimate stage (otherwise termed the "penultimate effluent") comprises $C_5$+ hydrocarbons which can be separated into at least an intermediate reformate and a heavy reformate. The effluent further comprises hydrogen and $C_4$− hydrocarbons. A hydrogen-rich stream may be separated from the penultimate effluent in a preliminary separation step, using, for example, a high pressure separator or other flash zone. $C_4$− hydrocarbons in the effluent may also be separated in a preliminary separation, either along with the hydrogen or in a subsequent flash zone. The intermediate reformate is characterized as having a lower mid-boiling point than that of the heavy reformate. In some embodiments, the intermediate reformate boils in the range from about 70° F. to about 280° F. In some such embodiments, the intermediate reformate comprises at least 70 vol. % $C_5$-$C_8$ hydrocarbons. In some embodiments, the intermediate reformate boils in the range from about 100° F. to about 280° F. In some such embodiments, the intermediate reformate comprises at least 70 vol. % $C_6$-$C_8$ hydrocarbons. In some embodiments, the intermediate reformate boils in the range from about 100° F. to about 230° F. In some such embodiments, the intermediate reformate comprises at least 70 vol. % $C_6$-$C_7$ hydrocarbons.

Recovery of an intermediate reformate fraction may be accompanied by the further recovery of a largely $C_5$ light reformate fraction. The light reformate is characterized as having a lower mid-boiling point than that of the intermediate reformate. In some embodiments, the light reformate fraction boils in the range from about 70° F. to about 140° F. In some such embodiments, the light reformate fraction comprises at least 70 vol. % $C_5$ hydrocarbons. The heavy reformate that is produced during separation of the upgraded product boils in the range of about 220° F. and higher. In some such embodiments, the heavy reformate comprises at least 70 vol. % $C_9$+ hydrocarbons.

The RON of the intermediate reformate is indicative of the mild reforming conditions in the penultimate stage. As such, the intermediate reformate typically has an RON of greater than about 65. In some embodiments the intermediate reformate has an RON within the range of about 65 to less than about 100. In some such embodiments the intermediate reformate has an RON within the range of about 65 to less than about 95.

Final Stage

Final Stage Catalyst

The final stage reforming catalyst comprises at least one medium pore molecular sieve. The molecular sieve is a porous inorganic oxide characterized by a crystalline structure which provides pores of a specified geometry, depending on the particular structure of each molecular sieve. The phrase "medium pore," as used herein means having a crystallographic free diameter in the range of from about 4.5 to about 7.1 Angstrom when the porous inorganic oxide is in the calcined form. The medium pore molecular sieves used in the practice of the present invention are generally 1-D, 2-D or 3-D structures, with the pores characterized as being 10-, 11- or 12-ring structures. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75). In a preferred embodiment, the medium pore molecular sieve is a high silica ZSM-5 zeolite such as silicalite.

Silicalite has a crystal structure which is nominally based on that of ZSM-5. Various references disclosing ZSM-5 are provided in U.S. Pat. No. 4,401,555 to Miller. These references include U.S. Pat. No. 4,061,724 to Grose et al.; U.S. Pat. Reissue No. 29,948 to Dwyer et al.; Flanigan et al., Nature, 271, 512-516 (Feb. 9, 1978) which discusses the physical and adsorption characteristics of high silica ZSM-5; Bibby et al., Nature, 280, 664-665 (Aug. 23, 1979) which reports the preparation of a crystalline silicate called "silicalite-2" and Anderson et al., J. Catalysis 58, 114-130 (1979) which discloses catalytic reactions and sorption measurements carried out on ZSM-5. The disclosures of these references and U.S. Pat. No. 4,401,555 are incorporated herein by reference, particularly including their disclosures on methods of making high silica to alumina crystalline ZSM-5 type zeolites. Additional disclosure on the preparation and properties of high silica ZSM-5 may be found, for example, in U.S. Pat. No. 5,407,558.

As synthesized, a ZSM-5 useful in the present process (according to U.S. Pat. No. 4,061,724) has a specific gravity at 77° F. of 1.99%±0.05 g/cc, as measured by water displacement. In the calcined form (1112° F. in air for one hour), this ZSM-5 has a specific gravity of 1.70%±0.05 g/cc. With respect to the mean refractive index of silicalite crystals, values obtained by measurement of the as synthesized form and the calcined form (1112.degree. F. in air for one hour) are 1.48%±0.01 and 1.39%±0.01, respectively.

In one embodiment, the ZSM-5 for use in the final stage of the process of the invention has a high silica to alumina molar ratio. The ZSM-5 useful in the process of the invention is a high silica ZSM-5 zeolite with a molar ratio of $SiO_2$:$M_2O_3$ of at least 40:1, preferably at least 200:1 and more preferably at least 500:1, where M is selected from Al, B, or Ga. In some embodiments, the $SiO_2$:$M_2O_3$ mole ratio is at least 1000:1.

The size of the ZSM-5 crystallites in the final stage catalyst can vary. In embodiments, the ZSM-5 is characterized as having an average crystallite size less than about 10 microns. More preferably, the average crystallite size is less than about 5 microns and most preferably the average crystallite size is less than about 1 micron. In embodiments, the ZSM-5 final stage catalyst is characterized as having at least 80% crystallinity, more preferably at least 90% crystallinity, most preferably at least 95% crystallinity. Strong acidity is undesirable in the catalyst because it promotes cracking, resulting in lower selectivity. To reduce acidity, the ZSM-5 catalyst preferably contains an alkali metal and/or an alkaline earth metal. The alkali or alkaline earth metals are preferably incorporated into the catalyst during or after synthesis of the molecular sieve. Preferably, at least 90% of the acid sites are neutralized by introduction of the metals, more preferably at least 95%, most preferably at least 100%. In one embodiment, the intermediate pore molecular sieve has less than 5,000 ppm alkali. Such intermediate pore silicate molecular sieves are disclosed, for example, in U.S. Pat. No. 4,061,724 and in U.S. Pat. No. 5,182,012. These patents are incorporated herein by reference, particularly with respect to the description, preparation and analysis of silicates having the specified silica to alumina molar ratios, having a specified crystallite size, having a specified crystallinity and having a specified alkali content.

ZSM-5 is more particularly described in U.S. Pat. No. 3,702,886 and U.S. Pat. Re. 29,948, the entire contents of which are incorporated herein by reference.

The crystalline molecular sieve may be in the form of a borosilicate, where boron replaces at least a portion of the aluminum of the more typical aluminosilicate form of the silicate. Borosilicates are described in U.S. Pat. Nos. 4,268,420; 4,269,813; 4,327,236 to Klotz, the disclosures of which patents are incorporated herein, particularly those disclosures related to borosilicate preparation.

The final stage catalyst according to the present invention contains one or more Group VIII metals, e.g., nickel, ruthenium, rhodium, palladium, iridium or platinum. The preferred Group VIII metals are iridium, palladium, and particularly platinum which are believed to be more selective with regard to dehydrocyclization and are more stable under the dehydrocyclization reaction conditions than other Group VIII metals. The preferred percentage of the Group VIII metals, such as platinum, in the catalyst is between 0.1 wt. % and 5 wt. %, more preferably from 0.3 wt. % to 2.5 wt. %. The Group VIII metal can be incorporated into the final stage catalyst using any method known in the art such as ion exchange, homogeneous deposition precipitation, redox chemistry, chemical vapor deposition, and impregnation.

The final stage catalyst can optionally include promoter metals such as tin and/or rhenium. The promoter metal can be incorporated into the final stage catalyst using any method known in the art such as ion exchange, homogeneous deposition precipitation, redox chemistry, chemical vapor deposition, and impregnation. In an embodiment, the catalyst includes sufficient promoter metal to provide a promoter to Group VIII ratio between 0.5:1 and 10:1, more preferably between 1:1 and 6:1, most preferably between 2:1 and 5:1.

Following catalytic metal incorporation, the final stage catalyst can be dried and/or calcined and/or sulfided. In an embodiment, the final stage catalyst is sulfided prior to use. This involves converting the metal components in the catalyst to their sulfided form. The sulfiding can be done by means of processes known to the skilled person, for example, by contacting the catalyst with a sulfur source such as elemental sulfur, sulfur containing compounds, or with a mixture of hydrogen and hydrogen sulfide. In an embodiment, the final stage catalyst comprises platinum and is sulfided with DMDS (dimethyldisulfide) prior to use.

The final stage catalyst can further comprise one or more inorganic oxide matrix components such as amorphous alumina. Examples of inorganic oxide matrix components which may be employed in formulating the final stage catalyst, include, but are not limited to, amorphous silicas, aluminas, silica-aluminas, silica-zirconias, silica-magnesias, silica-thorias, silica-berylias, silica-alumina-thorias, silica-alumina-zirconias, alumina-borias, alumina-titanias and mixtures thereof. The matrix may be in the form of a sol, hydrogel or gel and is typically an alumina, silica, or silica-alumina component. The matrix may itself provide a catalytic effect, such as that observed for catalytically active silica/aluminas, or it may be essentially inert. The matrix may act as a "binder" in some instances although in some instances the final catalyst may be spray dried or formed without the need of a binder.

Final Stage Conditions

Reaction conditions in the final reforming stage are specified to effectively utilize the particular performance advantages of the catalyst used in the stage. Thus, in the process of the invention, the reaction pressure of the final reforming stage is relatively low, for example less than 200 psig, preferably less than 150 psig, more preferably less than 100 psig, and most preferably less than 75 psig. In some embodiments, the pressure of the final stage can range from about 40 psig to about 200 psig. Operating the final reforming stage at a low pressure is made possible, at least in part, by the high catalytic stability of the high silica ZSM-5 final stage catalyst used in the process of the invention, which permits the final stage catalyst to operate at low pressures without undo fouling and premature activity failure. This, in turn, permits the operation of the penultimate stage at relatively mild conditions, providing reasonable catalyst life and high yields of desired high octane products.

The naphtha feed to the final stage (herein referred to as "final stage feed") comprises at least a portion of the penultimate effluent. In the process of the invention, the final stage feed contacts the catalyst in the final stage at reforming reaction conditions, which reaction conditions include a temperature in the range from about 800° F. to about 1100° F., a pressure in the range from about 40 psig to about 200 psig and a feed rate in the range of from about 0.5 $hr^{-1}$ to about 5 $hr^{-1}$. In some embodiments, the pressure in the reforming stage is less than 100 psig. Hydrogen is preferably added as an additional feed to the final reforming stage to facilitate hydrogenation reactions, but it is not required. In an embodiment, the hydrogen to hydrocarbon feed mole ratios are about 1 to 8 and in other embodiments are about 1 to 5. In embodiments, hydrogen added with the feed is recovered from the final stage effluent and can be recycled to the final stage.

Final Stage Product

Depending on the particular process, the effluent from the final reforming stage may contain light (i.e. $C_4$− products and/or hydrogen) products which may be removed from the reformate prior to further processing, blending, or use as a fuel. The $C_5$+ reformate which is produced in the final reforming stage has an increased RON relative to that of the final stage feed. In some embodiments, the RON of the final effluent is at least 90. In other embodiments, the RON is at least 95, or at least 98.

EXAMPLES

In the following examples, the RON values are calculated values, based on RON blending correlations applied to a composition analysis using gas chromatography. The method was calibrated to achieve a difference between measured RON values, determined by ASTM D2699, and calculated RON values of within ±0.8.

Example 1

Catalyst A. An extrudate comprising about 65 wt % Beta zeolite (25:1 silica to alumina mole ratio) and 35 wt % alumina binder was impregnated with platinum. The material was then ion exchanged with CsCl. Catalyst A had a final platinum content of 0.46 wt. % and a final cesium content of 15 wt %. The catalyst was calcined and sulfided with 200 ppm DMDS in hexane prior to use.

Example 2

Catalyst B. Catalyst B was a high silica to alumina ZSM-5 zeolite catalyst with a silica to alumina mole ratio of 780. The catalyst was impregnated with platinum. The final platinum content was 0.8 wt. % and the sodium content was 0.2 wt %. The catalyst was calcined and sulfided with 200 ppm DMDS in hexane prior to use.

Example 3

A naphtha feed, with an API of 60.5, RON of 89.1, 0.04 ppm sulfur and an ASTM D-2887 simulated distillation shown in Table 1 was reformed over 2 stages. In the first stage ("penultimate stage") catalyst A was used. Reaction conditions included a temperature of 975° F., a pressure of 70 psig, a 1:1 molar ratio of hydrogen to hydrocarbon and a feed rate of 3 $hr^{-1}$ LHSV. The effluent from this stage was then further reformed over catalyst B in the second stage ("final stage"). Reaction conditions included a temperature of 936° F., a pressure of 50 psig, a 1:1 molar ratio of hydrogen to hydrocarbon and a feed rate of 3 $hr^{-1}$ LHSV. The RON of the final product was 99 and the overall C5+ liquid yield was 78%.

The starting feed was a naphtha, with a 60.5 API gravity, 0.04 ppm sulfur, and the following simulated distillation:

TABLE 1

| LV % | ° F. |
|---|---|
| ST | 173 |
| 5 | 202 |
| 10 | 210 |
| 20 | 218 |
| 30 | 226 |
| 40 | 234 |
| 50 | 242 |
| 60 | 253 |
| 70 | 269 |
| 80 | 288 |
| 90 | 316 |
| 95 | 332 |
| EP | 378 |

Example 4 (Comparative)

Catalyst C. Catalyst C was a conventional reforming catalyst made according to U.S. Pat. No. 4,764,267. Catalyst C contained 0.3 wt. % platinum, 0.6 wt. % rhenium on an extruded alumina support. Catalyst C was substituted for Catalyst A and the reaction run as in Example 3 with the exception of the penultimate stage pressure was 200 psig. The RON of the final product was 99 and the overall C5+ liquid yield was 75%. Results for Examples 1-4 are summarized in Table 2.

TABLE 2

| | Example 3 (Invention) | Example 4 (Comparative) |
|---|---|---|
| RON (Calc.) of product | 99 | 99 |
| Catalyst Temp (° F.) | Cat. A 975<br>Cat. B 936 | Cat. C 930<br>Cat. B 936 |
| Catalyst Pressure | Cat. A 70 psig<br>Cat. B 50 psig | Cat. C 200 psig<br>Cat. B 50 psig |
| H2/HC | 1:1 | 1:1 |
| Benzene (Wt %) | 5.4 | 2.5 |
| Overall yield, LV %, C5+ | 78 | 75 |

As shown in Table 2, for the same product RON, the process of the invention (Example 3) gives a higher overall liquid yield and a higher overall yield of benzene than a conventional process (Example 4).

I claim:

1. A reforming process comprising:

a. contacting a naphtha boiling range feedstock in a penultimate stage of a multistage reforming process at a first reforming pressure with a catalyst comprising a low acidity beta zeolite and a Group VIII metal to produce a penultimate effluent; and b. contacting at least a portion of the penultimate effluent in a final stage of the multi-stage reforming process at a second reforming pressure and conditions sufficient to increase the amount of aromatics and thereby increase the RON with a catalyst comprising high silica ZSM-5 and a Group VIII metal to produce a final effluent, with the ZSM-5 having a $SiO_2$:$M_2O_3$ molar ratio of at least 200:1, where M is Al, B, Ga or combinations thereof, and with the ZSM-5 having at least 90% of its acid sites neutralized.

2. The process of claim 1, wherein at least 85 wt. % of the naphtha boiling range feedstock boils in the range from about 100° to about 400° F.

3. The process of claim 1, wherein the RON of the penultimate effluent is higher than the RON of the naphtha boiling range feedstock.

4. The process of claim 1, wherein the RON of the final effluent is higher than the RON of the penultimate effluent.

5. The process of claim 1, wherein the first reforming pressure is within the range of about 40 psig to 200 psig.

6. The process of claim 5, wherein the first reforming pressure is within the range of about 50 psig to 150 psig.

7. The process of claim 1, wherein the second reforming pressure is within the range of 40 psig to 200 psig.

8. The process of claim 7, wherein the second reforming pressure is within the range of about 40 psig to 100 psig.

9. The process of claim 1, wherein the first reforming pressure and the second reforming pressure are the same.

10. The process of claim 1, wherein the Group VIII metal of the penultimate stage catalyst comprises platinum.

11. The process of claim 1, wherein the beta zeolite has a $SiO_2$:$M_2O_3$ molar ratio of at least 20:1, where M is Al, B, Ga, or combinations thereof.

12. The process of claim 11, wherein the beta zeolite has a $SiO_2$:$M_2O_3$ molar ratio of at least 25:1, where M is Al, B, Ga, or combinations thereof.

13. The process of claim 11, wherein the beta zeolite has a $SiO_2$:$M_2O_3$ molar ratio of at least 50:1, where M is Al, B, Ga, or combinations thereof.

14. The process of claim 1, wherein the beta zeolite comprises Group IA metal ions, Group IIA metal ions, or combination thereof.

15. The process of claim 14, wherein the beta zeolite has an X:M mole ratio of at least 1:5, where X is a Group IA metal ion, a Group IIA metal ion, or combination thereof and M is Al, B, Ga, or combinations thereof.

16. The process of claim 1, wherein the ZSM-5 has a $SiO_2$:$M_2O_3$ molar ratio of at least 500:1, and, M is Al, B, Ga or combinations thereof.

17. The process of claim 1, wherein the ZSM-5 has less than 5,000 ppm alkali.

18. The process of claim 1, wherein the Group VIII metal of the final stage catalyst comprises platinum.

19. The process of claim 1, further comprising separating the penultimate effluent into two or more fractions.

20. The process of claim 1, wherein the ZSM-5 catalyst has at least 95% of its acid sites neutralized.

* * * * *